United States Patent [19]

Riches et al.

[11] Patent Number: 4,976,632

[45] Date of Patent: Dec. 11, 1990

[54] DATA BUS CONTACT

[75] Inventors: Arthur J. Riches; Derek Andrews, both of Herne Bay, England

[73] Assignee: Amphenol Corporation, Wallingford, Conn.

[21] Appl. No.: 256,860

[22] Filed: Oct. 12, 1988

[51] Int. Cl.[5] ..... H01R 17/18

[52] U.S. Cl. ..... 439/580; 29/828; 439/733; 439/745

[58] Field of Search ..... 439/578, 579, 580, 581, 439/582, 583, 584, 585, 277, 733, 745; 29/828

[56] References Cited

U.S. PATENT DOCUMENTS 4,553,806 11/1985 Forney, Jr. et al. ..... 439/277

*Primary Examiner*—Z. R. Bilinsky

*Attorney, Agent, or Firm*—Bacon & Thomas

[57] ABSTRACT

A triaxial contact assembly for terminating a screened twisted pair of wires comprises three contact members (12,14,16) and a ferrule (18). The inner contact (12) is of conventional construction but the intermediate contact member (14) consists of an intermediate contact (20) to which are secured the inner insulator (34) and a spacer member (40). The outer insulator (54) is fixed to the outer contact (52). The number of separate components required to be assembled by the operator is thus reduced and assembly made quicker and easier.

14 Claims, 1 Drawing Sheet

DATA BUS CONTACT

BACKGROUND OF THE INVENTION

The present invention relates to a triaxial contact assembly having an intermediate contact within an outer contact and an inner contact within the intermediate contact, the inner and intermediate and outer contacts being isolated from one another by means of inner and outer insulators respectively.

A triaxial contact assembly includes three electrical contacts, inner, intermediate and outer, isolated from one another by inner and outer insulators. Taking into account additional components needed to retain the finished assembly on the cable, triaxial contact assemblies suitable for terminating screened, twisted wire pairs have generally included at least seven components.

Examples of such contact assemblies are known from published European patent applications Nos. 0190843 and 0067727 and from United Kingdom application No. 2085676. The latter two documents describe assemblies having ten loose components each; that of application 0190843 has nine such components.

In assembling such contact arrangements onto the cable, some twelve to fifteen separate operations must be carried out, the most difficult of which has been found to be the feeding of an already mounted inner contact, together with the bared multi-cored wire into the intermediate contact while hampered by a loose spacer (that is the disc-like member which spaces the ferrule, which retains the assembly on the cable, from the inner components of the contact assembly).

SUMMARY OF THE INVENTION

The contact assembly of the invention is characterised in that at least one of the insulators is fixed to one of the contacts. Preferably, a spacer member for spacing the inner or intermediate contact from a ferrule onto which the outer contact is crimped to secure the assembly to a cable, is fixed to the intermediate contact. Preferably, the inner and intermediate contacts are provided with retaining means interengageable to secure them together; the retaining means being deformable to allow the inner contact to be inserted into the intermediate contact so as to interengage the retaining means but acting to oppose disengagement thereof. At least one of the contacts may be provided with a bore for receiving an end of a wire; there being adjacent the inlet end of said bore a conical guide surface for guiding the wire into the bore.

BRIEF DESCRIPTION OF THE DRAWINGS

A contact assembly in accordance with the invention will now be described in detail, by way of example, with reference to the drawings in which.

DESCRIPTION OF THE PREFERRED EMBODIMENT

Figure 1:
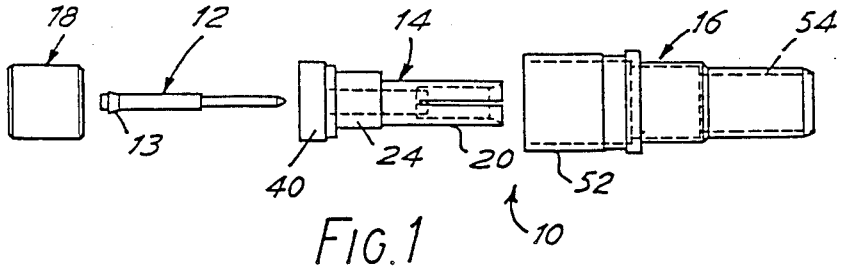
FIG. 1 is an exploded view showing the four components of a pin contact assembly in accordance with the invention.
Figure 2:
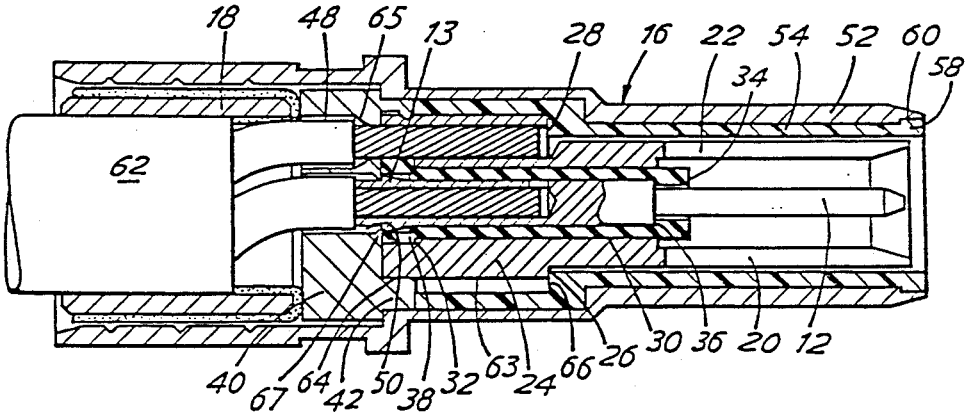
FIG. 2 is a sectional view of the contact assembly of FIG. 1.

The triaxial contact assembly 10 shown in FIGS. 1 and 2 comprises three contact members, an inner contact member 12, an intermediate contact member 14 and an outer contact member 16. In use, the three are disposed concentrically, one within the other. The fourth component of the assembly shown in FIG. 1 is a ferrule 18 onto which is crimped the outer contact member 16 to retain the contact assembly in place on the cable.

The inner contact member 12 is a conventional pin, or male, contact typically formed by machining from bar stock. It is provided, towards the rear, with a projecting conical lip 13.

The intermediate contact member 14 includes a hollow tubular intermediate contact 20 which has a forward portion 22 of smaller diameter than its rearward part 24 so that, at the junction of the forward and rearward parts 22 and 24 a radially-extending annular lip 26 is formed. The intermediate contact 20 has two through bores 28 and 30 formed in it. The bore 28 is offset from the central axis of the contact assembly and extends only through the rearward part 24 of the intermediate contact 20. In use, the bore 28 receives the end of one of the multi-core wires of the twisted wire pair.

The other bore 30 is centred on the axis of the contact assembly 10 and extends through both the forward and rearward parts 22 and 24 of the intermediate contact 20. The bore 30 has three parts. At its forward end where, when fully assembled, it surrounds the inner contact member 12, it is of relatively large diameter. At its rearmost end it is also of relatively large diameter, but in its middle region it is of smaller diameter so that an outwardly extending annular lip 32 is formed close to the rearward end of the bore 30.

The intermediate contact member 14 also includes the inner insulator 34 which, in use, serves to isolate the inner and intermediate contacts 12 and 20 from one another.

The inner insulator 34 is generally tubular and of external diameter such that it fits closely in the narrower middle region of the bore 30. At its forward end it has an inturned annular lip 36 and at its rearward end it has an outwardly extending annular flange 38. The insulator 34 is inserted into the bore 30 of the intermediate contact 20 until the annular flange 38 at the rearward end of the insulator 34 bears against the annular lip 32 at the rearward end of the bore 30 in the intermediate contact 20. In this position, the end surface of the insulator 34 is flush with the radially-extending end surface of the intermedate contact 20.

The insulator 34 is held in place in the intermediate contact 20 by the third part of the intermediate contact member 14, the spacer 40.

The spacer 40, is generally disc-shaped and is of diameter greater than the intermediate contact 20. At its forward end, it is extended to form a sleeve 42 which, in use, surrounds the rearward end portion of the intermediate contact 20. The sleeve 42 has an inwardly directed lip 44 at its forward end which is received in an annular groove 46 which runs around the periphery of the intermediate contact 20. Alignment of the bores 48 and 50 with the bores 28 and 30 is ensured by the provision of a flat key face 63, which is machined onto the rearward part 24 of the intermediate contact 14 and which cooperates with a corresponding flat key face 64 formed on the interior of the sleeve part 42 of the spacer 40.

The spacer 40 also has two through bores 48 and 50 formed in it which are, in use, aligned with the bores 28 and 30 formed in the intermediate contact member 20.

The intermediate contact member 14 is assembled by pushing the inner insulator 34 into the bore 30 of the intermediate contact 20 and then snapping the spacer 40 onto the rearward end of the contact 20 to hold the insulator in place. Once assembled, the intermediate contact member 14 can be handled as a single, integral unit as the three parts are held firmly together with no play between them.

The outer contact member 16 consists of two parts, the outer contact or body 52 and the outer insulator 54. Both parts are generally tubular and fit one within the other.

The outer insulator 54 has a forward part of internal cross-section such that the forward part of the intermediate contact 20 fits closely within it. The rearward part of the insulator 54 is of larger diameter, and is, in fact, of the same diameter as the forwardly-projecting sleeve 42 of the spacer 40. In use, the forward end of the sleeve 42 bears against the rearward edge of the outer insulator 54 thus forming a continuous insulating sleeve between the intermediate and outer contacts 14 and 16. The insulator 54 also has an outwardly-projecting retaining lip 58 formed at its forward end.

The outer body 52 has an internal bore whose diameter increases stepwise towards the rear of the contact assembly 10. At its forward end, the outer body 52 fits closely around both the forward and rearward parts of the outer insulator 54. At its rearward end the outer body 52 is of sufficiently large internal diameter to receive the spacer 40 and ferrule 18.

At its forward edge, the outer body 52 is formed with an annular recess 60 which co-operates with the retaining lip 58 on the outer insulator 54. The insulator 54 is snapped into place, the engagement of the retaining lip 58 in the recess 60 then serving to hold the outer body 52 and insulator 54 together so that they can be handled as a single unit.

The contact assembly 10 is assembled onto a screened twisted wire pair cable 62 as follows.

The ferrule 18 is slid onto the end of the cable 62. The outer sheath of the cable 62 is then stripped from the end portion of the cable and the screen, which is formed of braided copper wire, combed out and folded back over the outer sheath and ferrule 18. Once any fillers have been removed from the stripped portion of the cable, the inner contact 12 can be crimped, in a conventional manner, onto a suitably stripped end portion of one of the pair of twisted wires.

The end of the second wire is then stripped for insertion into the intermediate contact member 14.

It is the next stage of the assembly which is particularly difficult in existing contact assemblies. However, two features of the assembly shown in the drawings help to make this stage of the procedure easier.

The bore 48 formed in the spacer 40 has an inwardly directed conical surface 65 at its end adjacent the intermediate contact 20. The conical surface in the bore 48 helps to guide any stray strands of the second multi-core wire into the bore 28 formed in the rearward portion of the intermediate contact 20.

The internal diameter of the bore 50 at its forward end is slightly reduced to act as a deformable retaining lip 67. The inner contact 12 is provided with a rear conical lip 13 which acts as a barb or tang. As the inner contact 12 is inserted through the spacer 40 into the bore 30 of the intermediate contact 20, the lip 67 deforms. Once in place, the inner contact cannot, however, be withdrawn due to the engagement of the tang 13 with the edges of the lip 67 of the bore 50 of the spacer 40.

These two features, taking in combination with the fixed spacer 40 make insertion of the inner contact 12 and second wire into the intermediate contact member 14 relatively easy and all that remains to secure the intermediate contact member to the cable 62 is to crimp the periphery of the bore 28 onto the second wire, while pushing the wire firmly into the bore. The flat key surface 63 on the intermediate contact 14 is used to locate and align the crimping tool.

Using a suitable tool, the ferrule 18 is then pushed along the cable 62 until it butts up against the rear of the spacer 40 with the combed-out braided screen turned back over it. The now combined inner and intermediate contact members 12 and 14 are then inserted into the central opening of the outer contact member 16. Movement of the assembled inner and intermediate contact members 12 and 14 into the central bore of the outer contact member 16 is limited by the abutment of the outwardly-projecting lip 26 on the intermediate contact 20 against an inwardly directed shoulder 66 formed on the interior of the outer insulator 54. The portion of the outer body 52 which overlies the ferrule 18 is then crimped onto the ferrule 18 trapping the screen in the process and onto the cable to secure the whole contact assembly 10 in place.

It will be seen from the description above that assembly of the triaxial contact arrangement shown in the drawings is easier and quicker than that of existing assemblies whist being simple and relatively inexpensive to manufacture and retaining the sequential termination of wires by conventional crimping methods.

Figure 3:
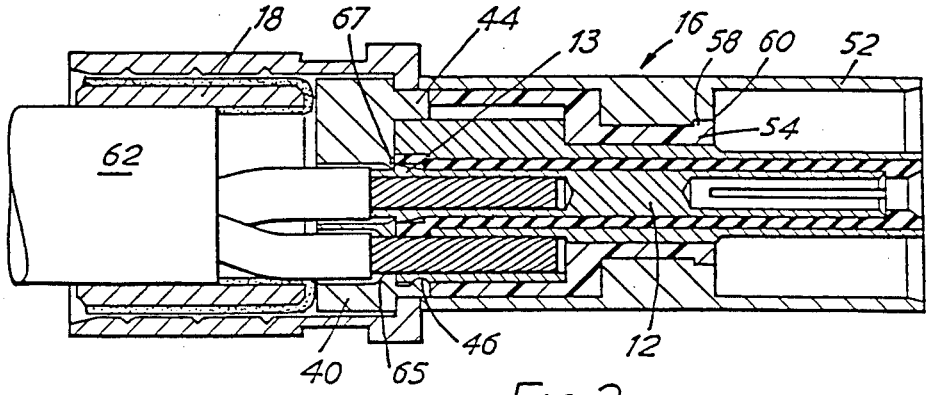
FIG. 3 is a sectional view of a socket contact assembly for use with the pin contact assembly of FIG. 2.

Although only the pin contact assembly 10 shown in FIG. 2 has been described in detail it will readily be appreciated that a socket contact assembly of the type shown in FIG. 3 can easily be constructed in accordance with the invention. It will also be understood that, whilst the assembly shown in the drawings has only a single group of contacts, the invention is also applicable to a multi-way contact, that is, a connector arrangement in which a plurality of inner and intermediate contact members are disposed in a common outer connector member or shell.

We claim:

1. A triaxial contact assembly comprising an intermediate contact coaxially positioned within an outer contact and an inner contact coaxially positioned within the intermediate contact, the inner and intermediate and intermediate and outer contacts being isolated from one another by means of inner and outer insulators respectively; and retaining means on at least one of said contacts for fixing and axially positioning one of said insulators in respect to said one of said contacts, wherein said one of said contacts and said one of said insulators forms a discrete subassembly of the triaxial contact assembly.

2. An assembly according to claim 1 wherein said one of said contacts is the outer contact and said one of said insulators is the outer insulator.

3. An assembly according to claim 1 wherein said one of said contacts is the intermediate contact and said one of said insulators is the inner insulator.

4. An assembly according to claim 3 further comprising a ferrule and a spacer member for spacing the intermediate contact from said ferrule onto which the outer contact is crimped to secure the assembly to a cable, the spacer including means engageable with said means on said intermediate contact for securing both said spacer and said inner insulator to said intermediate contact, wherein said spacer, said intermediate contact, and said inner insulator form a discrete subassembly of the triaxial contact assembly.

5. An assembly according to claim 3, further comprising second retaining means on at least one of the outer contact and outer insulator for fixing said outer contact to said outer insulator.

6. An assembly according to claim 1 in which another of said one of said insulators and contacts is provided with a second retaining means engageable with said first retaining means for securing said one of said insulators and said one of said contacts together; one of said retaining means being deformable to allow said one of said insulators and said one of said contacts to be snapped together to interengage the two retaining means while acting to oppose disengagement of the two retaining means.

7. An assembly according to claim 1 in which the intermediate contact is provided with a bore for receiving an end of a wire; there being adjacent the inlet end of the said bore a conical guide surface for guiding the wire into the bore.

8. An assembly according to claim 1, in which the retaining means are deformable to allow the inner contact to be inserted into the intermediate contact as to interengage to retaining means while acting to oppose disengagement thereof.

9. A triaxial contact assembly having an intermediate contact within an outer contact and an inner contact within the intermediate contact, the inner and intermediate and intermediate and outer contacts being isolated from one another by means of inner and outer insulators respectively, and further comprising a ferrule and a spacer member fixed to the intermediate contact for spacing the intermediate contact from said ferrule onto which the outer contact is crimped to secure the assembly to a cable, wherein each of the insulators and contacts are provided with retaining means interengageable to secure respective contacts and insulators together the retaining means being deformable to allow the respective insulators and contacts to be snapped together with the retaining means acting to oppose disengagement thereof.

10. A triaxial contact assembly having an intermediate contact within an outer contact and an inner contact within the intermediate contact, the inner and intermediate and intermediate and outer contacts being isolated from one another by means of inner and outer insulators respectively; and retaining means on at least one of said contacts and insulators for fixing one of said insulators to said one of said contacts, wherein said one of said insulators and said one of said contacts form a discrete subassembly which may be pre-assembled prior to assembly of the contact assembly, wherein at least one of the contacts is provided with a bore for receiving an end of a wire, there being adjacent the inlet end of said bore a conical guide surface for guiding the wire into the bore.

11. An assembly according to claim 9 or 10 further comprising a ferrule and a spacer member for spacing the intermediate contact from said ferrule onto which the outer contact is crimped to secure the assembly to a cable, the guide surface being formed on the spacer member.

12. A triaxial contact assembly having an intermediate contact within an outer contact and an inner contact within the intermediate contact, the inner and intermediate and intermediate and outer contacts being isolated from one another by means of inner and outer insulators respectively, wherein the inner and intermediate contacts are each provided with retaining means respectively interengagable with each other for securing the inner and intermediate contacts together; the retaining means being deformable for allowing the inner contact to be inserted into the intermediate contact until the respective retaining means interengage, and for subsequently acting to oppose disengagement thereof.

13. (New) A triaxial contact assembly comprising an intermediate contact with an outer contact and an inner contact within the intermediate contact, the inner and intermediate and intermediate and outer contacts being isolated from one another by means of inner and outer insulators respectively; and retaining means on at least one of said insulators for fixing one of said contacts to said one of said insulators, such that said one of said contacts and said one of said insulators form a discrete pre-aligned subassembly of the triaxial contact assembly.

14. A method of assembling a triaxial contact assembly including an intermediate contact within an outer contact and an inner contact within the intermediate contact, the inner and intermediate and intermediate and outer contacts being isolated from one another by means of inner and outer insulators respectively, comprising the steps of:

placing said inner insulator within said intermediate contact;

providing a spacer;

securing said spacer onto said intermediate contact to thereby secure said inner insulator within said intermediate contact;

inserting said inner contact through a bore in said spacer;

inserting wires through respective bores in said inner and intermediate contacts;

securing said outer insulator onto said outer contact;

completing assembly by inserting the intermediate contact together with said spacer, said wires, said inner insulator and said inner contact into said secured together outer contact and outer insulator.

* * * * *